US008230631B2

(12) United States Patent
Chapin

(10) Patent No.: US 8,230,631 B2
(45) Date of Patent: Jul. 31, 2012

(54) DISPLAY FRAME

(76) Inventor: John Archer Chapin, Bethesda, MD (US)

( * ) Notice: Subject to any disclaimer, the term of this patent is extended or adjusted under 35 U.S.C. 154(b) by 85 days.

(21) Appl. No.: 12/948,923

(22) Filed: Nov. 18, 2010

(65) Prior Publication Data

US 2012/0124878 A1 May 24, 2012

(51) Int. Cl.
*A47G 1/08* (2006.01)

(52) U.S. Cl. ..... 40/742; 40/741

(58) Field of Classification Search ..... 40/742, 40/739, 740, 741, 606.13; 52/656.1, 645; 182/195, 207
See application file for complete search history.

(56) References Cited

U.S. PATENT DOCUMENTS

| | | | | |
|---|---|---|---|---|
| 908,170 | A | | 12/1908 | Van Der Boom |
| 965,377 | A | | 7/1910 | Dreisbach |
| 1,202,321 | A | | 10/1916 | Schleicher |
| 1,341,971 | A | | 6/1920 | Chrobak |
| 1,342,477 | A | | 6/1920 | Walas |
| 1,346,691 | A | | 7/1920 | Babcock |
| 1,388,956 | A | | 8/1921 | Kozlowsky et al. |
| 1,548,249 | A | | 8/1925 | Binns |
| 2,016,941 | A | | 10/1935 | Horwitt |
| 2,016,942 | A | | 10/1935 | Horwitt et al. |
| 2,338,172 | A | | 1/1944 | Firks |
| 2,497,760 | A | | 2/1950 | Chambers |
| 2,790,259 | A | | 8/1954 | Havens |
| 2,776,508 | A | | 1/1957 | Hutson |
| 2,854,774 | A | | 10/1958 | Horwitt |
| 2,877,585 | A | | 3/1959 | Horwitt |
| 3,465,461 | A | | 9/1969 | Price et al. |
| 3,590,510 | A | | 7/1971 | Salz |
| 3,936,968 | A | | 2/1976 | Gilbert |
| 4,024,659 | A | * | 5/1977 | Ingerdahl ..... 40/741 |
| 4,176,480 | A | | 12/1979 | Euzarraga et al. |
| 4,477,990 | A | | 10/1984 | Buchanan |
| 4,773,174 | A | | 9/1988 | Boeniger et al. |
| 5,099,590 | A | | 3/1992 | Yamaguchi |
| 5,159,770 | A | | 11/1992 | Yamaguchi |
| 5,343,643 | A | | 9/1994 | Cochrane |
| 5,448,841 | A | * | 9/1995 | Hampton ..... 40/730 |
| 5,579,596 | A | | 12/1996 | Kovacs et al. |
| 6,163,995 | A | | 12/2000 | Lucchetti et al. |
| 6,854,204 | B2 | | 2/2005 | Uden |
| 2008/0209787 | A1 | | 9/2008 | Alcov |

* cited by examiner

*Primary Examiner* — Lesley D. Morris
*Assistant Examiner* — Christopher e Veraa
(74) *Attorney, Agent, or Firm* — Millen, White, Zelano & Branigan, P.C.

(57) ABSTRACT

An adjustable display frame has first and second U-shaped frame elements having aligned free end surfaces that abut to form a small display frame and are separated by first and second inert elements urged by a spring to provide a large display frame. Each U-shaped frame element has a pair of longitudinal slots which receive heads of headed studs projecting from a base disposed behind the frame elements, wherein the frame elements are secured to the base and are capable of sliding on the base from a first position, to provide the small frame, to a second position so as to provide the large frame. The inserts are slidable on the base inboard of the U-shaped frame elements and are spring biased so as to move between the free ends of the U-shaped frame elements when the U-shaped frame elements are separated by being pulled apart. Stops are provided for arresting motion of the inserts to align the inserts with the free ends of the U-shaped frame elements after the inserts have been pushed outwardly by the spring.

6 Claims, 6 Drawing Sheets

DISPLAY FRAME

FIELD OF THE INVENTION

This invention is directed to a display frame, more particularly to a display frame for images such as, but not limited to photographs, prints, paintings and the like, wherein the display frame is adjustable for images or presentations of images of different sizes.

BACKGROUND OF THE INVENTION

Most display frames or picture frames define a fixed area for displaying an image; however, from time to time it is necessary or desirable to expand a frame to accommodate images of larger sizes. This may occur with an image which is rectangular, rather than square and may have a width greater than its height. All frames are not configured to accommodate this problem by simply resting the frame on the long side, rather than the short side, or by resting the frame on the short side, rather than the long side. Display frames which are expandable to perform this function are known, however these frames do not function automatically to enlarge their display area, but rather require more than a one-step manipulation of the frame. Accordingly, there is a need for a simple, readily adjustable display frame which requires less manipulation to increase one dimension of its display area.

SUMMARY OF THE INVENTION

An adjustable display frame has first and second U-shaped frame elements having aligned free end surfaces which abut to form a small display frame and are separated by first and second insert elements to provide a large display frame. Each U-shaped frame element is defined by a pair of leg portions connected by a bight portion. Pairs of longitudinal slots are formed in portions of each frame element and a base disposed behind the U-shaped frame elements. The base has headed studs extending toward the frame elements, with each stud having a head received in one of the longitudinal slots in leg portions of the U-shaped elements, wherein the frame elements are secured to the base and are capable of sliding on the base from a first position to provide the small frame to a second position to provide the large frame. The inserts are slidably mounted on the base inboard of the U-shaped frame elements, the inserts being spring biased away from one another to move between the free ends of the U-shaped frame elements when the frame elements are longitudinally separated by being pulled apart. Stops are provided for arresting motion of the inserts to align the inserts with the free ends of the frame after the inserts are pushed by the spring.

In a further aspect of the display frame the inserts are biased toward the bight portions of the U-shaped frame elements by a coil spring.

In a further aspect of the display frame a dowel is disposed in the coil spring to prevent buckling of the coil spring.

In a further aspect of the display frame the inserts have T-shaped slots therein which receive T-shaped on the base. This allows the inserts to slide with respect to the base from the initial position inboard of the base when the frame is small to a position aligned with the free ends of the U-shaped frame elements when the frame is large.

In a further aspect the stop comprises interactive stop surfaces on the rails and in the slots.

In a further aspect each U-shaped frame element has a shelf defined on the rear surface thereof for receiving a glass panel and image panel.

DETAILED DESCRIPTION OF THE PREFERRED EMBODIMENT

Figure 1:
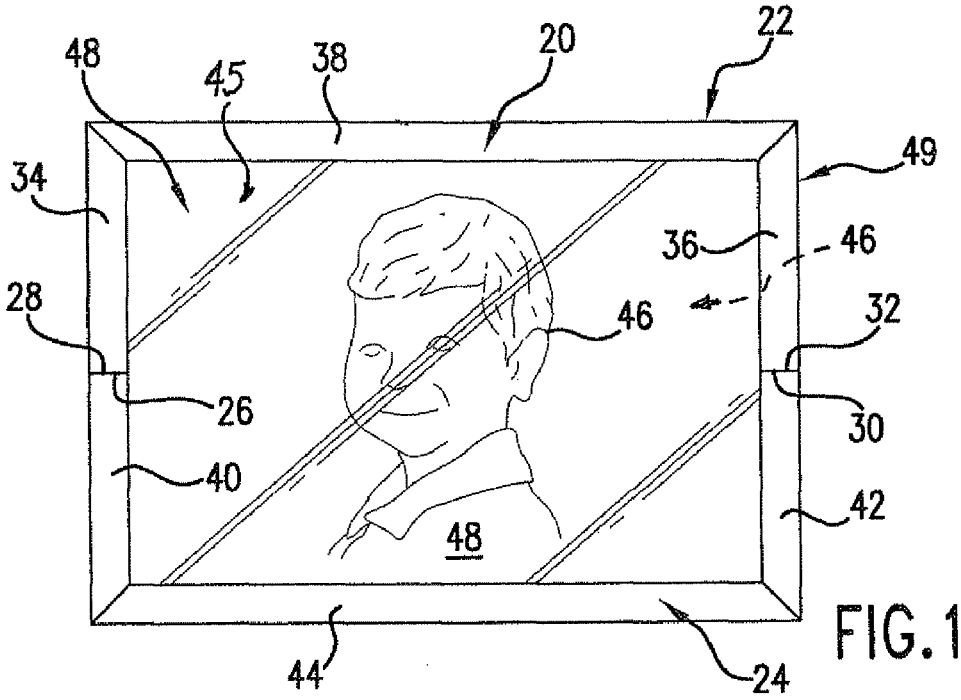
FIG. 1 is a front planar view of the adjustable display frame according to the present invention illustrating the frame in its smaller size.
Figure 2:
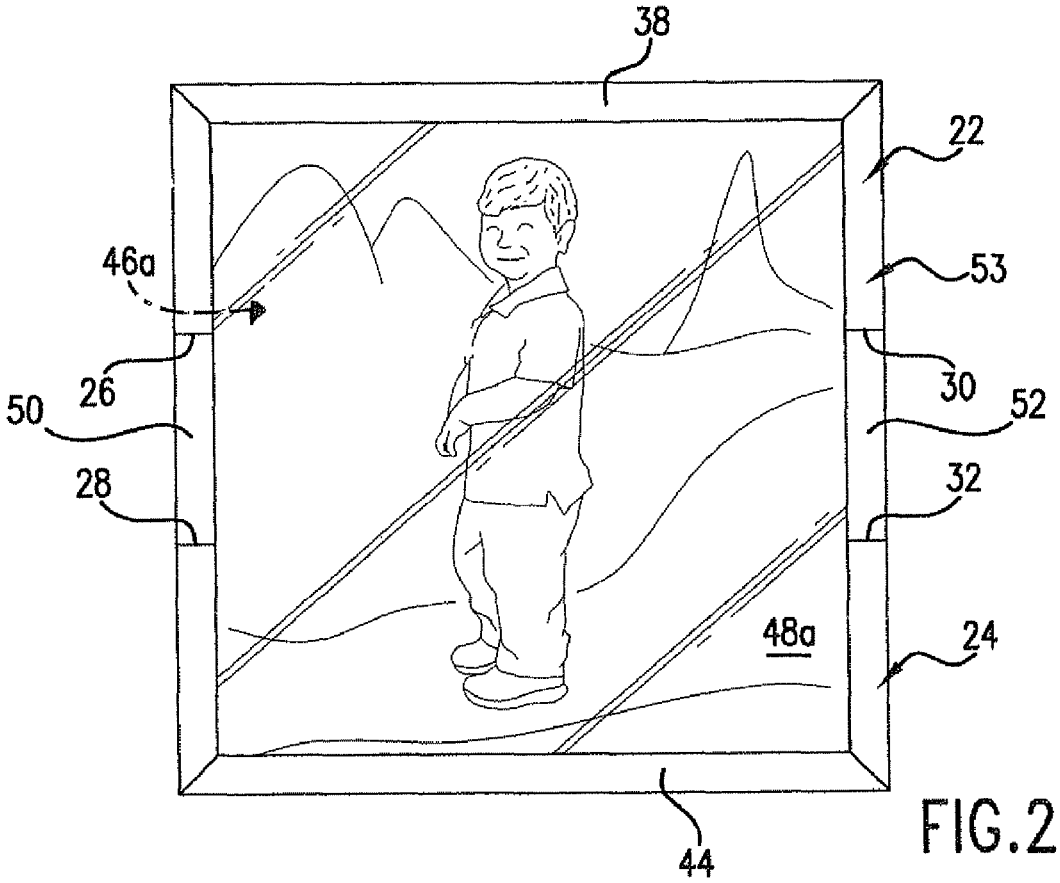
FIG. 2 is a front planer view of the adjustable display frame of FIG. 1 expanded to a larger size.

FIG. 1 is a view of an adjustable display frame assembly 20 having first and second U-shaped frame elements 22 and 24, respectively, which abut at free ends 30 and 32 to form a small display frame. In the illustrated embodiment, a first U-shaped frame element 22 has legs 32 and 36 joined by a bight 38, while a second U-shaped frame element 24 has legs 40 and 42 joined by a bight 44. In FIG. 1, the frame is rectangular because the bights 38 and 44 are parallel with the abutting legs 34 and 40 being parallel with the abutting legs 36 and 42 and the legs all being perpendicular to the bights 34 and 44. FIGS. 1 and 2 are an illustrated embodiment of the adjustable display frame 20. The adjustable display frame 20 need not be rectangular but may be of another shape, for example the bights 38 and 44 may be curved as may be the legs 34, 40 and 36, 42. The adjustable display frame 22 defines a display area 45 for an image panel 46 which may be a photograph, a print, a painting or any other type of image. The image may be with or without matting and may be covered by a transparent panel 48 inside of glass or plastic. FIG. 1 illustrates the adjustable display frame and its small frame configuration 49.

Referring now to FIG. 2, first and second inserts elements 50 and 52 are shown disposed between the free ends 26 and 30 of the first U-shaped frame element 20 and free ends 28 and 32 of the second U-shaped frame element 24 to provide a large display frame 53 which is higher or longer when compared to the small display frame 49. This is accomplished by automatic insertion of the first and second inserts 50 and 52 as is shown in FIGS. 3-8 and by replacing the image panel 46 and transparent panel 48 with larger image and transparent panels 46*a* and 48*a* respectively. In order to facilitate changing of the transparent panels 48 and 48*a*, the transparent panels are preferably made of flexible glass, plexiglass or flexible plastic. The image panels 46 and 46*a* are also preferably made of flexible material.

Figure 3:
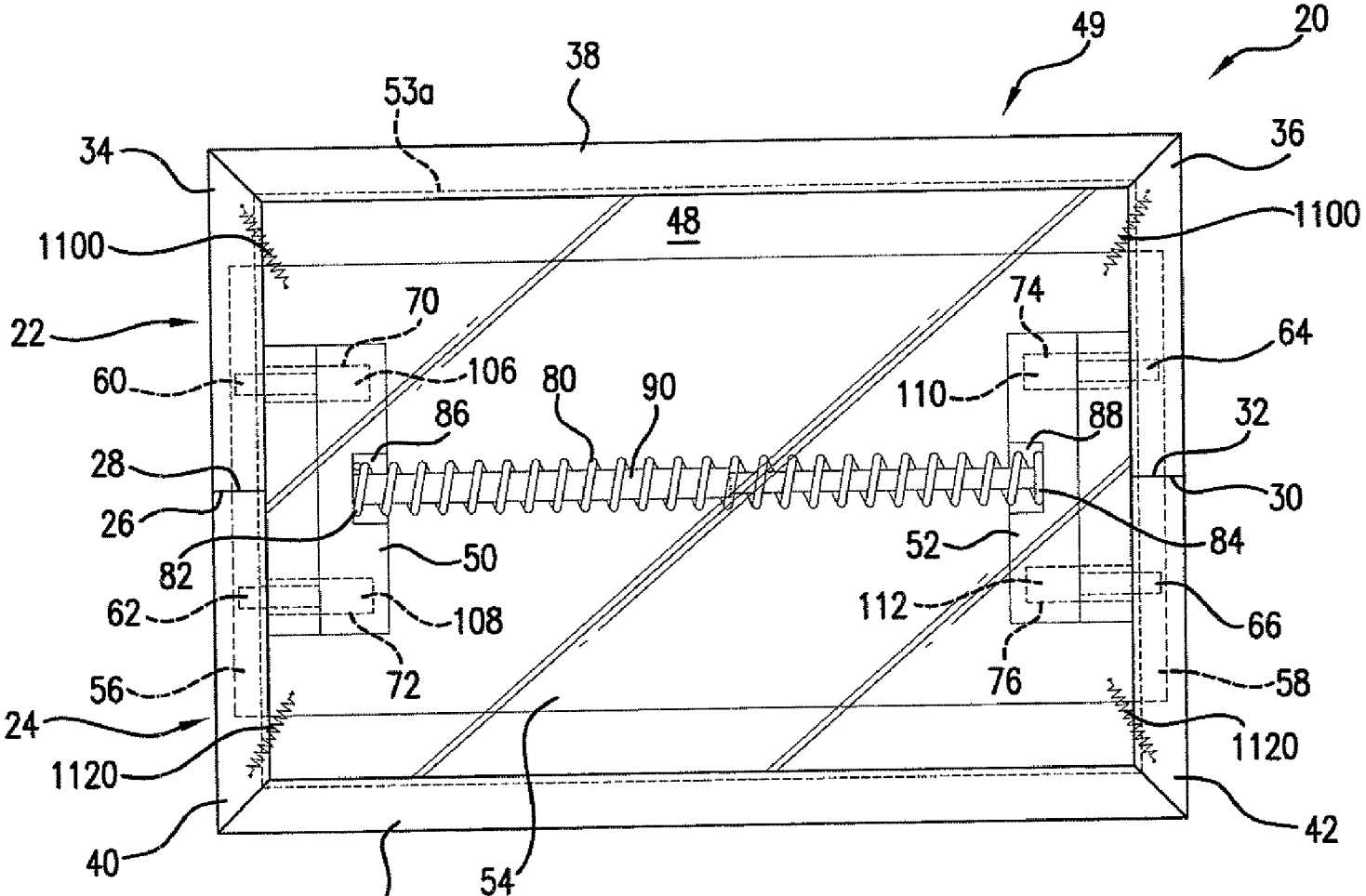
FIG. 3 is a front view of the adjustable frame with the image and mat deleted revealing a front view of the mechanism as originally positioned before expending the adjustable display frame.

Referring now to the front view of FIG. 3, the panel or substrate bearing the image 44 has been deleted so that one may observe structures behind the glass or plastic panel 48 which are normally hidden by the image panel 46. FIG. 3 shows in dotted lines a shelf 53 supports the image panel 46 and transparent panel 48. A shelf 53*a* is formed on the inserts 50 and 52 for also accommodating the panels 46 and 48. The inserts 50 and 52 are mounted on a base panel 54 positioned behind and in underlying relationship with the first and second U-shaped frame elements 22 and 24. As is shown by dotted line portions 56 and 58 the base panel underlies the U-shaped frame elements 22 and 24. The inserts 50 and 52 are mounted on pairs of rails 60, 62 and 64, 66 that are fixed to and project outwardly from the base panel 54. The pairs of rails 60, 62 and 64, 66 are received in slots 70, 72 and 74, 76 in the inserts 50 and 52, respectively. A coil spring 80 is disposed between the inserts 50 and 52 with the free ends 82 and 84 of the coil spring 80 being received in pockets 86 and 88 within the inserts 50 and 52, respectively. Coil spring 80 urges the inserts 50 and 52 apart and thus braises the inserts toward the legs 34, 40 and 36, 42 of the U-shaped frame elements 22 and 24. A dowel 90 is positioned within the coil spring 80 to prevent the coil spring from buckling and to ensure that its coil spring 80 directs its force toward the inserts 50 and 52 so as to bias the inserts 50 and 52 toward the U-shaped frame elements 22 and 24.

Figure 4:
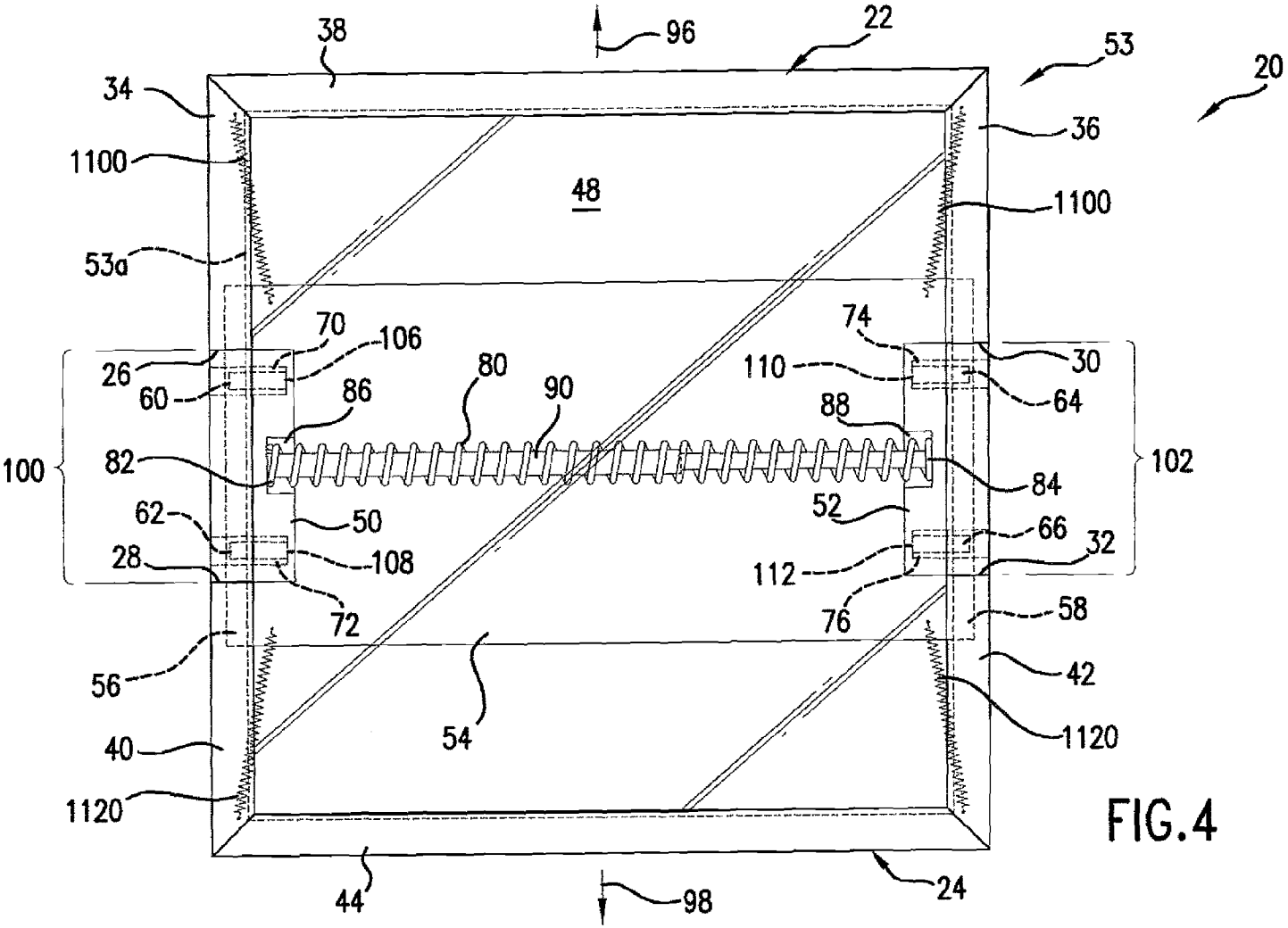
FIG. 4 is a front view of the adjustable display frame with the image and mat deleted and a larger glass inserted after inserts have been used to enlarge the frame.

As is seen in FIG. 4, if it is desired to expand the small frame 49 into the large frame 53, the U-shaped frame elements 22 and 24 are pulled apart in the directions of arrows 96 and 98. This causes spaces 100 and 102 to occur between the free ends 26, 28 and 30, 32 of the U-shaped frame elements 22 and 24 into which spaces the inserts 50 and 52 are projected under the bias of coil spring 80. A stop arrangement is provided by engagement of rails 60 and 62 at bottom surfaces 106 and 108 of slots 70 and 72 and insert 50 an engagement of the rails 64 and 66 with the bottom surfaces 110 and 112 and the insert 52. The stopping arrangement ensures that the insert 50 aligns with the legs 34 and 40 and the insert 52 correctly aligns with the legs 36 and 42 of the U-shaped frame elements 22 and 24, respectively. To help facilitate abutment between the U-shaped frame elements 22 and 24 with the inserts 50 and 52 coil springs 110 are disposed between the base 54 and the distil ends of the first U-shaped claim element 22 and coil springs 112 are disposed between the base 54 and the distil portions of the U-shaped frame element 24. The coil springs 110 and 112 are shown in the current position for clarity of their function. Placement at other locations to provide bias between the base panel 54 and the U-shaped frame elements 22 and 24 that urges the frame elements toward one another may be preferred. For example, the coil springs 110 and 112 are placed in the slots 130, 132 and 134, 136 of FIGS. 5-8.

Figure 6:
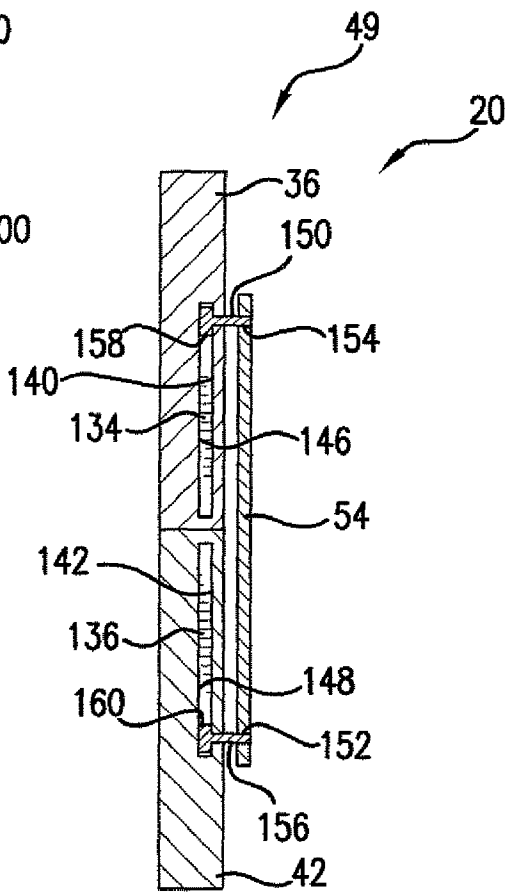
FIG. 6 is a side view taken along lines 6-6 of FIG. 5.
Figure 5:
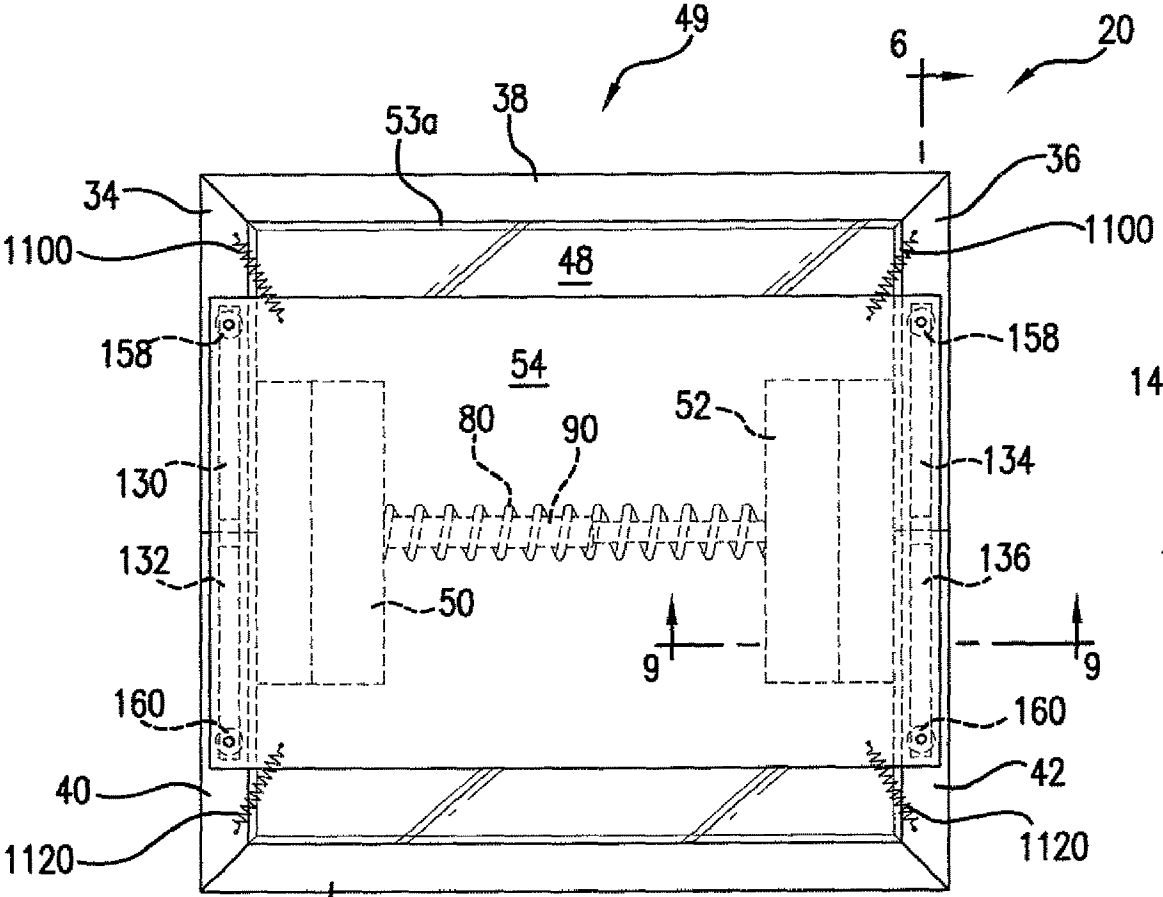
FIG. 5 is a back view of the adjustable display frame shown in FIGS. 1-4.

Referring now to FIG. 5 and to FIG. 6, FIG. 6 being an elevation taken along lines 6-6 of FIG. 5, back and side views of the smaller frame configuration 49 are illustrated with portions of the operating structures showing in dotted lines because they are covered by the base panel 54. As is seen in FIGS. 5 and 6, the legs 34 and 40 have slots 130 and 132 therein and the legs 36 and 42 have slots 134 and 136 therein. In FIG. 5, the base panel 54 overlies the slots 130, 132, 134 and 136 so the slots are shown in dotted lines. As is evident from FIG. 6 in combination with FIG. 5, the slots 134 and 136 (as well as the slots 130 and 132) have longitudinal extending lips 140 and 142 which are spaced apart to provide narrow longitudinal openings 146 and 148 therein which receive shanks 150 and 152 of screws 154 and 156 therethrough. The screws 154 and 156 have heads 158 and 160 received in the slots 134 and 136, which heads are retained therein by the lips 140 and 142. This both secures the frame legs 36 and 32 (as well as 34 and 40) to the base panel 54 and allows the U-shaped frame elements 22 and 24 to be pulled apart against the bias of springs 110 and 112 as the headed screws 54 and 56 slide in the slots 134 and 136 (as well as the slots 130 and 132). The inserts 50 and 52 remain retracted in their FIG. 5 position until the U-shaped frame elements 22 and 24 separate far enough apart to provide the gaps 100 and 102 that permit the inserts 50 and 52 to slide outwardly to hold the adjustable frame 20 configured as the larger frame 49 shown in FIGS. 7 and 8.

Figure 7:
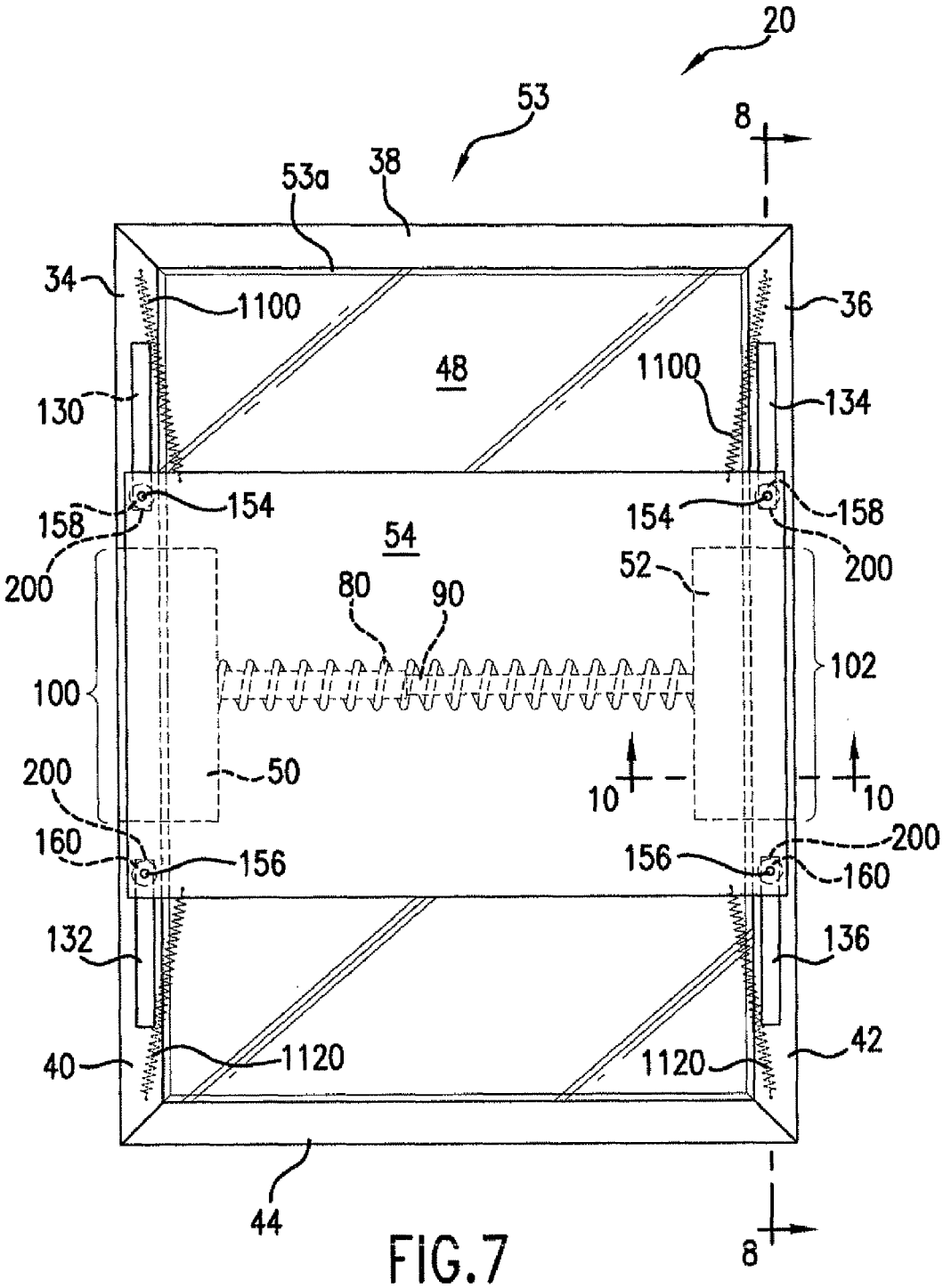
FIG. 7 is a back view of the adjustable display frame of FIG. 2.
Figure 8:
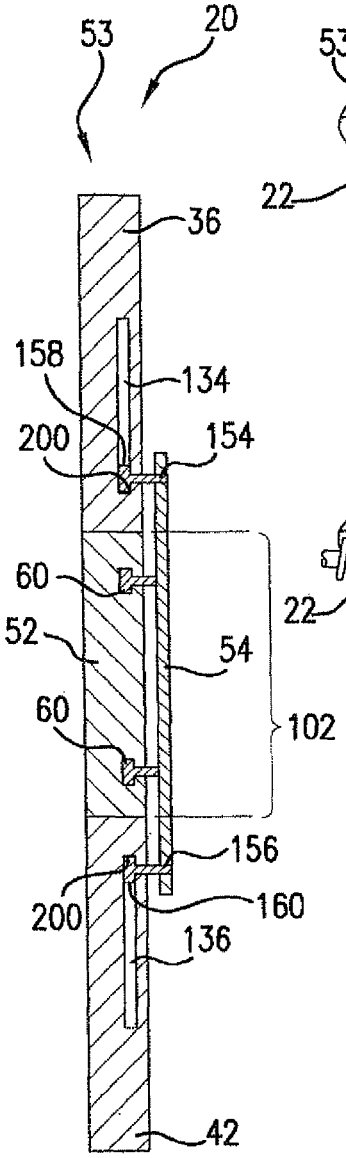
FIG. 8 is a side elevation taken along lines 8-8 of FIG. 7.

As is seen in FIGS. 7 and 8, portions of the slots 130 and 132 and the slots 134 and 136 are now visible from the rear of the frame having been pulled out from behind the base panel 54. The screws 150, 152 and 160, 162 are now at the opposite end of the slots 130, 132 and 134, 136 where the screws bottom against the end 200 of the slots preventing further separation of the U-shaped frame elements 22 and 24. In order to easily accommodate the inserts 50 and 52, the gaps 100 and 102 are initially wider than the length of the inserts, but once the inserts have been projected, the springs 110 and 112 pull the U-shaped frame elements 22 and 24 back against the inserts 50 and 52 to provide the larger frame 49 with a smooth exterior appearance.

Figure 9:
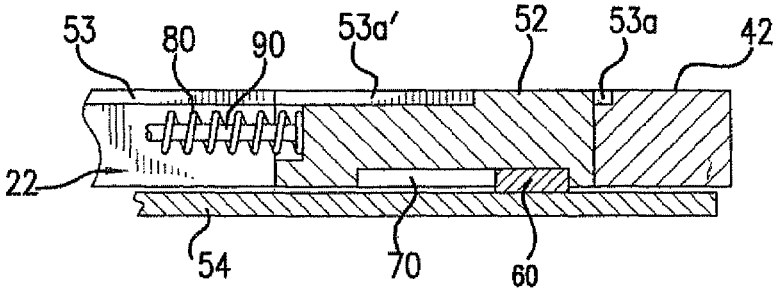
FIG. 9 is an elevation taken along lines 9-9 of FIG. 5.
Figure 10:
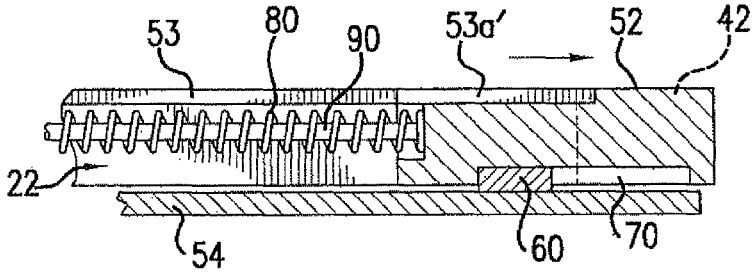
FIG. 10 is a portion shown in elevation taken along lines 10-10 of FIG. 8.

As is seen in FIGS. 9 and 10, the rails 60, 62, 64 and 66 shown in FIG. 3 allow the inserts 50 and 52 to slide outward until the rails bottom against the back of the slots 70, 72, 74 and 76. Since the rails 60, 62, 64 and 66 are T-shaped as shown in FIG. 8, the rails retain the inserts 50 and 52 on the panel base 54 while allowing the inserts 50 and 52 to slide.

Without further elaboration, it is believed that one skilled in the art can, using the preceding description, utilize the present invention to its fullest extent. The preceding preferred specific embodiment is therefore, to be construed as merely illustrative, and not limitative of the remainder of the disclosure in any way whatsoever.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. An adjustable display frame comprising:

first and second U-shaped frame elements having aligned free end surfaces which abut to form a small display frame and are separated by first and second insert elements to provide a large display frame, each U-shaped frame element being defined by a pair of leg portions connected by a bight portion;

pairs of longitudinal slots in the leg portions of each frame element;

a base disposed behind the U-shaped frame elements, the base having headed studs extending toward the frame elements with each stud having a head received in one of the longitudinal slots in the leg portions of the U-shaped elements, wherein the frame elements are secured to the base and are capable of sliding on the base from a first position to provide the small frame to a second position to provide the large frame;

the inserts being slidably mounted on the base inboard of the U-shaped frame elements, the inserts being spring biased away from one another to move between the free ends of the U-shaped frame elements when the frame elements are longitudinally separated by being pulled apart, and stops for arresting motion of the inserts to align the inserts with the free ends of the frame after the inserts are pushed by the spring.

2. The display frame of claim 1, wherein the inserts are biased toward the bight portions of the U-shaped frame elements by a coil spring.

3. The display frame of claim 2, wherein a dowel is disposed in the coil spring to prevent buckling of the coil spring.

4. The display frame of claim 1, wherein the inserts have T-shaped slots therein that receive T-shaped rails therein which are on the base which allow the inserts to slide with respect to the base from the initial position inboard of the base when the frame is small to a position aligned with the free ends of the U-shaped frame elements when the frame is large.

5. The display frame of claim 4, wherein the stop comprises interactive stop surfaces on the rails and in the slots.

6. The display frame of claim 1, wherein each U-shaped frame element has a shelf defined on the rear surface thereof for receiving a glass panel and image panel.

* * * * *